US009915095B2

(12) United States Patent
Durfee, III

(10) Patent No.: US 9,915,095 B2
(45) Date of Patent: Mar. 13, 2018

(54) LADDER-SUPPORTING GUTTER CLAMPING SYSTEM

(71) Applicant: David L. Durfee, Jr., Meadville, PA (US)

(72) Inventor: David (Davy) L. Durfee, III, Meadville, PA (US)

(73) Assignee: Ladder Mates USA, Meadville, PA (US)

( * ) Notice: Subject to any disclaimer, the term of this patent is extended or adjusted under 35 U.S.C. 154(b) by 0 days.

(21) Appl. No.: 14/979,100

(22) Filed: Dec. 22, 2015

(65) Prior Publication Data

US 2017/0175444 A1 Jun. 22, 2017

(51) Int. Cl.
*E06C 7/48* (2006.01)
*B25B 5/10* (2006.01)

(52) U.S. Cl.
CPC ..... *E06C 7/486* (2013.01); *B25B 5/103* (2013.01)

(58) Field of Classification Search
CPC ... E06C 7/48; E06C 7/06; E06C 7/188; B25B 5/04; B25B 5/06; B25B 5/10; B25B 5/103
USPC ..... 182/107
See application file for complete search history.

(56) References Cited

U.S. PATENT DOCUMENTS 296,145 A * 4/1884 Davis ..... E06C 1/52 182/163
1,879,058 A * 9/1932 Brockman ..... B25B 3/00 269/254 CS
2,537,703 A * 1/1951 Randa ..... F16L 3/00 24/332
2,595,699 A * 5/1952 Petersen ..... B25B 1/22 269/163
2,662,432 A * 12/1953 Peitl ..... B25B 1/04 269/218
3,853,202 A * 12/1974 Jarboe ..... E06C 7/486 182/108
3,910,380 A * 10/1975 Nameche ..... E06C 7/48 182/206
4,143,743 A * 3/1979 Larson ..... E06C 7/48 182/107
4,541,155 A * 9/1985 Gagnon ..... B66C 1/64 24/486
4,968,078 A * 11/1990 Fitzwater ..... B25B 5/06 24/509
5,201,501 A * 4/1993 Fassler ..... B23Q 1/76 269/156
5,320,444 A * 6/1994 Bookwalter ..... A61B 17/6408 248/231.41

(Continued)

FOREIGN PATENT DOCUMENTS

GB 1451919 A * 10/1976 ..... B25B 5/04

*Primary Examiner* — Colleen M Chavchavadze
(74) *Attorney, Agent, or Firm* — Richard K Thomson

(57) ABSTRACT

A clamping system for supporting an extension ladder on a gutter utilizes at least one and, more preferably, a pair of identical, clamp(s) to capture the ladder preventing movement laterally or horizontally away from the gutter. The clamp includes a clamp body with a latch pivotably mounted thereto which is spring biased to the gutter-clamping position. A lock screw may be utilized to prevent the latch from releasing the gutter preventing the ladder from moving. A pair of ears extends from each side of the clamp body and have slots which engage the channels on a forward face of the ladder leg.

8 Claims, 6 Drawing Sheets

(56) References Cited

U.S. PATENT DOCUMENTS 5,383,533 A * 1/1995 Nikula ..... E04D 15/00 182/107
5,595,375 A * 1/1997 Bennhausen ..... B25B 5/04 269/229
6,029,964 A * 2/2000 Bohl ..... B25B 5/163 269/166
6,044,930 A * 4/2000 Hayman ..... E06C 7/48 182/107
7,134,525 B1 * 11/2006 Ferris ..... E06C 7/486 182/107
7,380,640 B1 * 6/2008 Kemp ..... E06C 7/50 182/107
8,763,214 B2 * 7/2014 Yang ..... B25B 5/06 24/500
9,409,290 B1 * 8/2016 Gordon ..... B25J 1/04
2004/0169119 A1 * 9/2004 Crowell ..... B25B 5/06 248/316.4
2006/0124394 A1 * 6/2006 Bracken ..... E06C 1/34 182/107
2006/0272894 A1 * 12/2006 Hein ..... E06C 7/48 182/107
2007/0251762 A1 * 11/2007 Charlton ..... E06C 7/486 182/107
2009/0188750 A1 * 7/2009 Charlton ..... E06C 7/486 182/107
2012/0248673 A1 * 10/2012 Yung ..... B25B 5/10 269/240
2013/0306543 A1 * 11/2013 Beisser ..... A61M 5/1418 210/321.6
2014/0174853 A1 * 6/2014 Charlton ..... E06C 7/486 182/107
2015/0075905 A1 * 3/2015 Ballard ..... E06C 1/36 182/107
2016/0067846 A1 * 3/2016 Christensen ..... B25B 5/163 269/160

* cited by examiner

LADDER-SUPPORTING GUTTER CLAMPING SYSTEM

BACKGROUND AND SUMMARY OF THE INVENTION

The present invention is directed to the field of safety equipment. More particularly, the present invention comprises a clamping system including at least one, and preferably, a pair of clamp(s) which securely attach to a gutter adjacent each of the legs of an extension ladder preventing the ladder from sliding along or pulling away from the gutter and depositing its climber on the ground.

It would seem that as Autumn comes round on the calendar, the season gives another reason for associating the term "Fall" with it: numerous reports of ladder users' injuries, both professionals and DIYers, adorn the newspapers resulting from ladders slip-sliding along gutters resulting in each of these users taking a fall.

Quite a few attempts to provide a solution to this problem have been made to-date. However, none of these products have proven satisfactory. Some are too large and clunky; some too expensive; others simply do not perform as advertised.

It is among the purposes of this invention to provide a gutter clamp that is simple, effective, and easy to use, being as close to "fool"-proof as possible, given the inordinate amount of people copping to the description. A gutter clamping system for restraining a two-legged extension ladder against movement when leaned against a gutter, the gutter clamping system comprising at least one gutter clamp, each gutter clamp including a) a clamp body having a first gutter-engaging surface for being positioned on a first side of a rim of a gutter; b) a latch having a second gutter-engaging surface for being positioned on a second opposite side of the rim of a gutter; c) a latch pin pivotably mounting the latch to the clamping body, the latch pin permitting the latch to pivot between a first unengaged position and a second position engaging the gutter clamping the rim of the gutter between the first gutter-engaging surface and the second gutter-engaging surface; d) spring means engaged between the clamp body and the latch biasing the latch to the second position; e) at least one ear protruding from a first side of the clamp body for engaging a ladder leg; whereby the gutter clamp system secures a ladder against movement along a gutter by clamping at least one of said clamps to a rim of the gutter adjacent and engaging a first side of one of the two legs of the extension ladder. Preferably, the system employs a pair of such clamps and the second of the pair of clamps is secured to a rim of the gutter adjacent and engaging an opposite side of the other of the two legs of the extension ladder. This may be the outsides of the two legs or the insides of the two legs; either will suffice to prevent the ladder from sliding along or pulling away from the gutter.

The spring means comprises at least one coil spring interacting between the clamp body and an upper portion of the latch and, more preferably, the spring means comprises a plurality of coil springs interacting between the clamp body and an upper portion of the latch. Further, more preferably, the at least one ear comprises at least one ear protruding from each side of the clamp body whereby each gutter clamp may be positioned on either side of either leg of the two-legged extension ladder to engage in a channel of its respective ladder leg. The at least one ear comprises a plurality of ears protruding from each side of the clamp body, each one of the plurality having retention means associated therewith restricting unintended removal of the channel of the ladder therefrom.

As additional protection against slippage of the clamp, a lock screw threaded through a portion of said clamp body is provided, the lock screw being adapted to engage an upper portion of the latch whereby when the lock screw engages the upper portion of the latch, the latch will not pivot to the first disengaged position. A stop is formed on a forward portion of a threaded portion of the lock screw preventing the lock screw from being removed from the clamp body. Preferably, each latch includes a finger adapted to extend beneath a lip on the rim portion of the gutter to restrict upward movement of the gutter clamp relative to the rim portion of the gutter.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
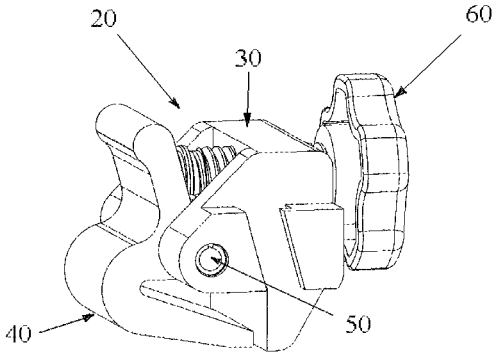
FIG. 1 is a front perspective view of the first embodiment a gutter clamp used in the clamping system of the present invention.
Figure 2C:
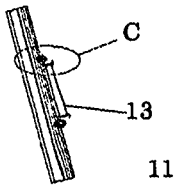
FIG. 2C is a schematic top view of the ladder shown in FIG. 2A.
Figure 2A:
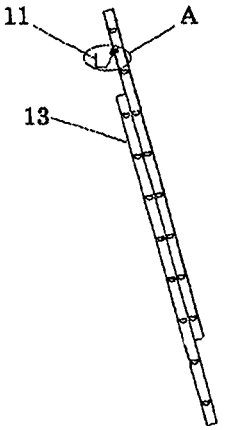
FIG. 2A is a schematic side view depicting a ladder leaning against a gutter.
Figure 2B:
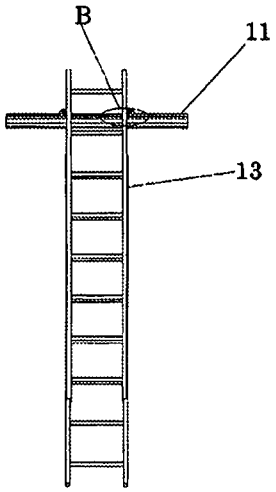
FIG. 2B is a schematic front view of the ladder shown in FIG. 2A.
Figure 3A:
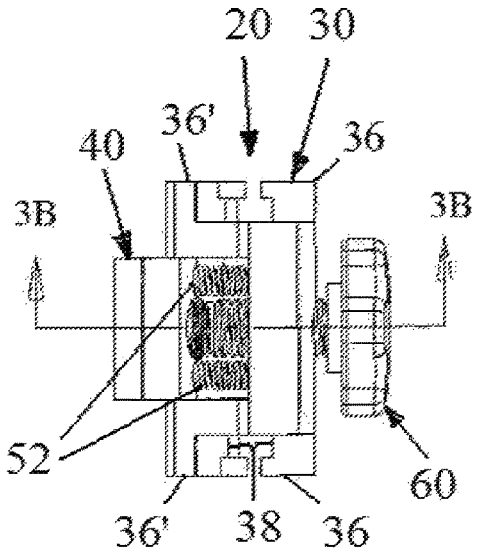
FIG. 3A is a top view of the clamp shown in FIG. 1.
Figure 3B:
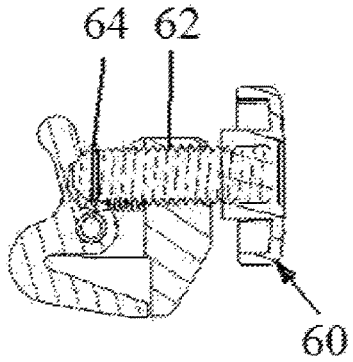
FIG. 3B is a cross-sectional view of the clamp shown in FIG. 3A as seen along line 3B-3B.
Figure 3C:
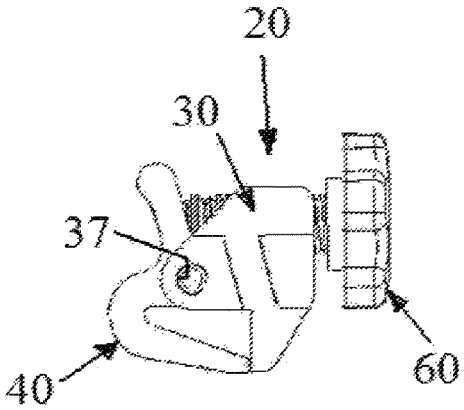
FIG. 3C is a side view of the clamp shown in FIG. 3A.
Figure 3D:
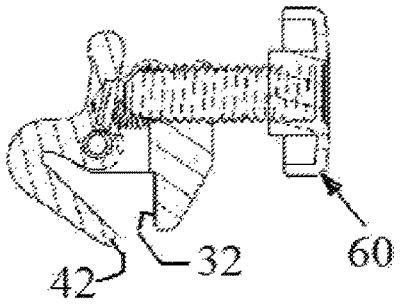
FIG. 3D is a cross-sectional side view similar to FIG. 3B with the locking screw retracted and the latch depicted in the open position.
Figure 4:
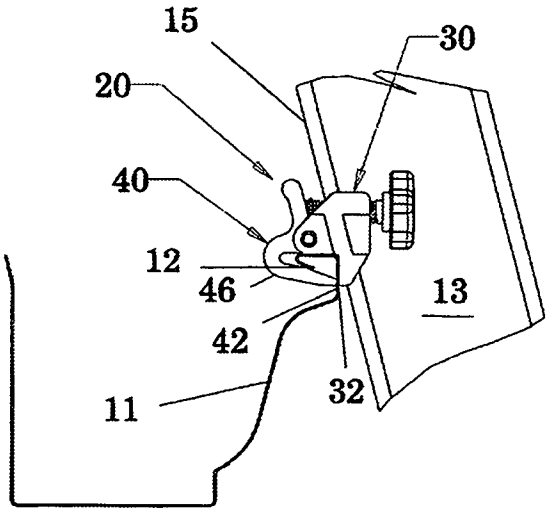
FIG. 4 is a detailed side view as taken from circle A in FIG. 2A.
Figure 5:
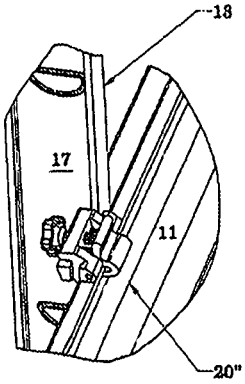
FIG. 5 is a detailed side perspective view as taken from circle B in FIG. 2B featuring a second embodiment of the clamp.
Figure 7:
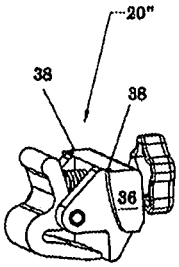
FIG. 7 is a front perspective view of the second embodiment.

A first embodiment of the gutter clamp used in the gutter clamp system of the present invention is depicted in FIGS. 1, 3-6 generally at 20. As best seen in FIGS. 1, 3A-3D, gutter clamp 20 comprises a clamp body 30 and a latch 40 pivotally attached to clamp body 30 by means of latch pin 50. When given its full range of motion, latch 40 can move between a first open position (FIG. 3D) and a second closed position (FIG. 3B) in which a first surface 32 on clamp body and a second surface 42 on latch 40 cooperate to grip opposite faces of gutter 11 (FIG. 5). Spring means comprises at least one spring, and more preferably a plurality of springs 52 engage between clamp body 22 and back surface 44 of latch 40 to bias latch 40 to its second closed position. The ends of springs 52 are seated in recesses (not shown) in each element to prevent slipping of the springs from their desired points of engagement. Depending on the spring rates of springs 52, the grip they afford on gutter 11 is sufficient to inhibit movement between the clamp 20 and gutter 11 in most situations. Nonetheless, lock screw 60 is present to provide an added level of safety. Clamp body 30 has an internal thread portion 34 which threadingly receives the threads 62 on lock screw 60. A retention means in the form of a lock ring 64 is provided which prevents lock screw 60 from being removed from clamp body 30.

As best seen in FIG. 3A, each clamp body 30 has a pair of ears 36, 36' extending from each side 35 which are spaced to receive a channel 15 of ladder 13. The forward set of ears 36' provide mounting recesses 37 for pivot pin 50. Each ear 36 has a slot 38 which may, depending on the design of the channel 15 of the ladder, serve as retention means restricting unintended removal of the channel 15 of ladder 13 therefrom. It will be understood that the function of slots 38 is of secondary importance given that clamp 20 is sufficient in its own right of preventing movement of ladder 13 relative to gutter 11, whether or not slots 38 have any engagement with portions of channels 15. The fact that each clamp body 30 has ears 36 extending in both directions allows clamp 20 to be positioned on either side of ladder 13 engaging either channel 15. In fact, in use, the pair of clamps 50 may be positioned to grasp the gutter 11 on the outside of each ladder leg or on the inside of each ladder leg, although, as a practical matter it will be far easier to maneuver the devices on the outside of the legs 17. Finger 46 of latch 40 is designed to extend under rim 12 of gutter 11, in designs where such a rim is present (FIG. 4). This affords added stability to the gutter clamping system provided by the pair of clamps 20.

Figure 8:
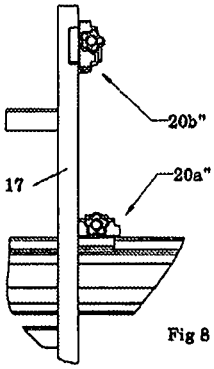
FIG. 8 is a front view of the second embodiment shown secured to the gutter with a second clamp shown in a storage position.
Figure 6:
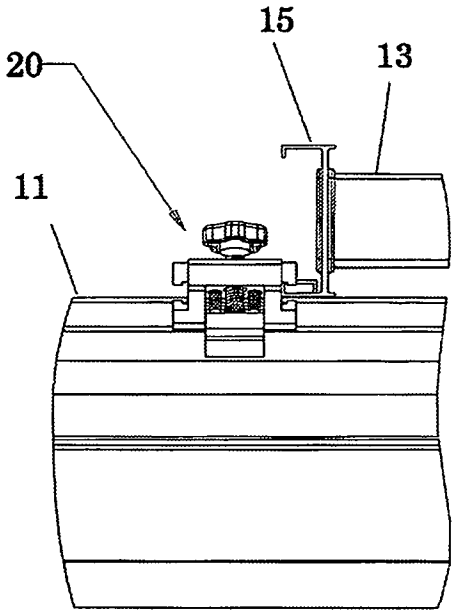
FIG. 6 is a top view taken from the circle C in FIG. 2C also featuring the second embodiment of the clamp.

A second embodiment of the gutter clamp of the present invention is seen in FIGS. 5-8 generally at 20". In this embodiment, the second ears 36' are removed and ears 36" provided with a radius which accommodates any angle at which ladder 13 is leaned enabling the slot 38" to engage channel 15 under all circumstances. FIG. 8 depicts a first clamp 20*a*" affixed to gutter 11 and a second clamp 20*b*" attached to the leg 17 of ladder 13. Clamp 20" can be attached to the ladder leg 17 prior to its being leaned against gutter 11 affording the climber hands-free gutter access.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A gutter clamping system for restraining a two-legged extension ladder against movement when leaned against a gutter, said gutter clamping system comprising at least one gutter clamp, each said gutter clamp including a) a clamp body having an inner face and an outer face, said inner face defining a first gutter-engaging surface for being positioned on a first side of a rim of a gutter, said clamp body defining a pair of outwardly extending arms protruding from an extension of said first gutter-engaging surface;

b) a latch having a second gutter-engaging surface for being positioned on a second opposite side of the rim of a gutter, said latch having an inner face positioned toward said inner face of said clamping body and an outer face extending away from said clamping body;

c) a latch pin pivotably mounting said latch to said clamping body between said pair of outwardly extending arms, said latch pin permitting said latch to pivot between a first unengaged position and a second position engaging the gutter clamping the rim of the gutter between said first gutter-engaging surface and said second gutter-engaging surface;

d) a pair of coil springs engaged between said inner face of said clamp body between said pair of outwardly extending arms and an upper portion of said inner face of said latch, each of said coil springs having a first end engaging said inner face of said clamp body and a second end engaging said upper portion of said inner face of said latch, said pair of coil springs biasing said latch to said second closed position;

e) at least one ear protruding from a first side of said clamp body for engaging a ladder leg;

whereby said gutter clamp system secures a ladder against movement along a gutter by clamping said at least one of said clamps to a rim of the gutter adjacent and engaging a first side of one of the two legs of the extension ladder thereby resisting both lateral movement along, as well as movement away from, the face of the gutter.

2. The gutter clamping system of claim 1 wherein said at least one gutter clamp comprises a pair of said clamps and a second one of said pair engages a first side of the other of the two legs of the extension ladder.

3. The gutter clamping system of claim 1 wherein said at least one ear comprises at least one ear fixed to and protruding an equal distance from each side of said clamp body whereby each said gutter clamp may be positioned on either side of either leg of the two-legged extension ladder to engage in a channel of its respective ladder leg.

4. The gutter clamping system of claim 3 wherein said at least one ear comprises a plurality of ears fixed to and protruding from each side of said clamp body, at least one of each of said plurality of ears having retention means associated therewith restricting unintended removal of the channel of the ladder therefrom.

5. The gutter clamping system of claim 4 wherein said retention means comprises a slot in each ear which captures a rib on a forward face of the ladder leg, the rib partially defining the channel.

6. The gutter clamping system of claim 1 wherein said latch includes a finger adapted to extend beneath a lip on the rim portion of the gutter to restrict upward movement of said gutter clamp relative to the rim portion of the gutter.

7. A gutter clamping system for restraining a two-legged extension ladder against movement when leaned against a gutter, said gutter clamping system comprising at least one gutter clamp, each said gutter clamp including a) a clamp body having an inner face and an outer face, said inner face defining a first gutter-engaging surface for being positioned on a first side of a rim of a gutter, said clamp body defining a pair of arms extending outwardly from an extension of said first gutter-engaging surface;

b) a latch having a second gutter-engaging surface for being positioned on a second opposite side of the rim of a gutter, said latch having an inner face positioned toward said inner face of said clamping body and an outer face extending away from said clamping body;

c) a latch pin pivotably mounting said latch to said clamping body between said pair of outwardly extending arms, said latch pin permitting said latch to pivot between a first unengaged position and a second position engaging the gutter clamping the rim of the gutter between said first gutter-engaging surface and said second gutter-engaging surface;

d) coil spring means engaged between said inner face of said clamp body between said pair of outwardly extending arms and an upper portion of said inner face of said coil spring biasing said latch to said second closed position;

e) at least one ear protruding from a first side of said clamp body for engaging a ladder leg;

f) a lock screw threaded through a base portion of said clamp body extending from said outer face through said inner face between said pair of outwardly extending arms colinearly with said coil spring means and being adapted to engage an upper portion of said latch whereby when said lock screw engages said upper portion of said latch, said latch is prevented from pivoting to said first disengaged position;

whereby said gutter clamp system secures a ladder against movement along a gutter by clamping said at least one of said clamps to a rim of the gutter adjacent and engaging a first side of one of the two legs of the extension ladder thereby resisting both lateral movement along, as well as movement away from, the face of the gutter.

8. The gutter clamping system of claim 7 further comprising a stop-lock ring positioned on a forward portion of a threaded portion of said lock screw preventing said lock screw from being removed from said clamp body.

* * * * *